US008661937B2

(12) United States Patent
Miyaji

(10) Patent No.: US 8,661,937 B2
(45) Date of Patent: Mar. 4, 2014

(54) CAM APPARATUS

(75) Inventor: Takayuki Miyaji, Kanagawa (JP)

(73) Assignee: Oiles Corporation, Tokyo (JP)

( * ) Notice: Subject to any disclaimer, the term of this patent is extended or adjusted under 35 U.S.C. 154(b) by 774 days.

(21) Appl. No.: 12/600,047

(22) PCT Filed: May 23, 2008

(86) PCT No.: PCT/JP2008/001300

§ 371 (c)(1),
(2), (4) Date: Nov. 20, 2010

(87) PCT Pub. No.: WO2008/146481

PCT Pub. Date: Dec. 4, 2008

(65) Prior Publication Data

US 2011/0203407 A1 Aug. 25, 2011

(30) Foreign Application Priority Data

May 24, 2007 (JP) ..... 2007-138434

(51) Int. Cl.
*B21D 5/04* (2006.01)

(52) U.S. Cl.
USPC ..... 74/567; 72/452.9

(58) Field of Classification Search
USPC ..... 74/110, 567; 100/266, 291; 72/315, 72/452.8, 452.9
IPC ..... B21D 28/32
See application file for complete search history.

(56) References Cited

U.S. PATENT DOCUMENTS

| | | | | |
|---|---|---|---|---|
| 5,881,599 | A * | 3/1999 | Sasahara et al. | 74/110 |
| 5,884,521 | A * | 3/1999 | Fidziukiewicz | 72/452.9 |
| 6,250,177 | B1 * | 6/2001 | Sasahara | 74/567 |
| 2003/0167874 | A1 | 9/2003 | Miyaji et al. | |

FOREIGN PATENT DOCUMENTS

| | | |
|---|---|---|
| JP | 2001-137946 | 5/2001 |
| JP | 2003-80326 | 3/2003 |
| JP | 2003-260526 | 9/2003 |

OTHER PUBLICATIONS

International Search Report for PCT/JP2008/001300, mailed Jul. 29, 2008.

* cited by examiner

*Primary Examiner* — Thomas Diaz
(74) *Attorney, Agent, or Firm* — Nixon & Vanderhye P.C.

(57) ABSTRACT

A cam apparatus of a suspended cam type includes a cam driver 2 having a sliding surface 9; a cam slide 3 which is moved with its sliding surface 28 in contact with the sliding surface 9 of the cam driver 2; a cam-slide supporting means 4 for supporting the cam slide 3 movably in an A direction; and a returning mechanism 5 for returning the cam slide 3 to its rear initial position in the A direction of that cam slide 3.

4 Claims, 5 Drawing Sheets

CAM APPARATUS

This application is the U.S. national phase of International Application No. PCT/JP2008/001300 filed 23 May 2008, which designated the U.S. and claims priority to Japan Application No. 2007-138434 filed 24 May 2007, the entire contents of which are hereby incorporated by reference.

TECHNICAL FIELD

The present invention relates to a cam apparatus for performing press working such as punching, bending, and the like with respect to a workpiece such as a thin plate by means of a tool fitted to a cam slide by causing the cam slide to slide by a cam driver.

BACKGROUND ART

[Patent Document 1] JP-A-2003-260526

A cam apparatus of a suspended cam type, for example, generally comprises a cam driver which is adapted to be fixedly supported by a cam-driver supporting base; a cam slide having a sliding surface with a shape complementary to the sliding surface of the cam driver so as to movably contact the sliding surface of the cam driver; a cam-slide supporting means for movably suspending and supporting the cam slide so that the cam slide can move while being guided by the sliding surface of the earn driver as the sliding surface of the cam slide and the sliding surface of the cam driver are brought into contact with each other; and a returning mechanism having a coil spring for generating a returning force for returning the cam slide to its initial position. The cam-slide supporting means has a cam-slide supporting base and a pair of cam-slide supporting plates which are fitted to the cam-slide supporting base by means of bolts and are disposed on both sides of the cam slide so as to suspend the cam slide.

DISCLOSURE OF THE INVENTION

Problems that the Invention is to Solve

At the time of adjustment, maintenance, and inspection of the cam slide, the returning mechanism, and the like in such a cam apparatus, a cam slide base portion of the cam slide is, in many cases, drawn out from between the cam-slide supporting base and the cam-slide supporting plates from the rear side of the cam-slide supporting base by backwardly sliding the cam slide with respect to the cam-slide supporting base to thereby separate the cam slide from the cam-slide supporting base. After the adjustment, maintenance, and inspection of the cam slide, the returning mechanism, and the like, the cam slide base portion of the cam slide is inserted again between the cam-slide supporting base and the cam-slide supporting plates from the rear side of the cam-slide supporting base to slide the cam slide forward with respect to the cam-slide supporting base, thereby installing the cam slide on the cam-slide supporting base. However, such an operation involves the backward and forward movement of the cam slide with respect to the cam-slide supporting base, and is therefore troublesome and requires much time.

On the other hand, if the cam slide can be directly drawn out and removed from the cam-slide supporting base by removing the cam-slide supporting plates from the cam-slide supporting base by loosening the bolts, it would be able to shorten the operation time of such as assembly in addition to adjustment, maintenance, and inspection. However, particularly in a case where a plurality of cam apparatuses are installed adjacent to each other to perform various press working such as punching, bending, and the like, there are cases where not only the cam slide per se but an adjacent cam slide or the like serves as an obstruction, making it difficult to loosen the bolts.

The present invention has been devised in view of the above-described aspects, and its object is to provide a cam apparatus which makes it possible to easily effect the dismounting and mounting of the cam slide with respect to the cam-slide supporting base without performing troublesome operation, thereby making it possible to speedily carry out the operation of maintenance, inspection, and replacement of the cam slide, the returning mechanism, and the like.

Means for Solving the Problems

A cam apparatus in accordance with the present invention comprises: a cam driver; a cam slide which is moved in contact with the cam driver; cam-slide supporting means for supporting the cam slide movably; and a returning mechanism for returning the cam slide to its rear initial position in a moving direction of the cam slide, wherein the cam slide includes: a rectangular parallelepiped cam slide base portion having a pair of sliding supported surfaces each jutting out in a direction perpendicular to the moving direction of the cam slide from each side surface in the perpendicular direction of the cam slide; and a tool mounting portion extending from the cam slide base portion, wherein the cam-slide supporting means includes: a cam-slide supporting base which has a front wall portion disposed on a forward side in the moving direction of the cam slide, a rear wall portion disposed on a backward side in the moving direction of the cam slide in face-to-face relation to the front wall portion, a pair of side wall portions extending in the moving direction of the cam slide and connected on its forward side to the front wall portion and on its backward side to the rear wall portion, and a bottom wall portion which is connected to the front wall portion, the rear wall portion, and the pair of side wall portions, respectively, so as to form an accommodating recess for accommodating the cam slide base portion movably in the moving direction of the cam slide by the front wall portion, the rear wall portion, the pair of side wall portions, and the bottom wall portion; and two pairs of cam-slide supporting plates which are respectively fitted to the pair of side wall portions of the cam-slide supporting base in such a manner as to be respectively aligned in the moving direction of the cam slide, and each of which has a supporting surface opposing a corresponding one of the supported surfaces of the cam slide base portion, wherein, in each of the pairs of cam-slide supporting plates, the cam-slide supporting plate located on the forward side in the moving direction of the cam slide has a moving-direction length shorter than a length in which a moving-direction length of the cam slide base portion accommodated in the accommodating recess is subtracted from a length of the accommodating recess in the moving direction of the cam slide, and wherein, in each of the pairs of cam-slide supporting plates, the cam-slide supporting plate located on the backward side in the moving direction of the cam slide is detachably fitted to the side wall portion by means of a bolt.

According to the above-described cam apparatus, in the pairs of cam-slide supporting plates, the cam-slide supporting plate located on the forward side in the moving direction of the cam slide has a moving-direction length shorter than a length in which a cam slide moving-direction length of the cam slide base portion accommodated in the accommodating recess is subtracted from a length of the accommodating recess in the moving direction of the cam slide, while, in the pairs of cam-slide supporting plates, the cam-slide supporting plate located on the backward side in the moving direction of the cam slide is detachably fitted to the side wall portion by means of a bolt. Therefore, by removing the cam-slide supporting plates on the backward side from the side wall portions, it is possible to withdraw or insert the cam slide base portion with respect to the accommodating recess through an opening of the accommodating recess in a direction perpendicular to the moving direction of the cam slide. As a result, it is possible to easily effect the dismounting and mounting of the cam slide with respect to the cam-slide supporting base without performing troublesome operation, thereby making it possible to speedily perform the operation of maintenance, inspection, and replacement of the cam slide, the returning mechanism, and the like.

In a preferred example, the cam slide base portion includes a base portion body with which the tool mounting portion is integrally formed; a pair of sliding side plates which are respectively fitted to both side surfaces of the base portion body and each has a sliding surface which is in contact with an inner wall surface of a corresponding one of the side wall portions slidably in the moving direction of the cam slide; and a sliding bottom plate fitted to a bottom surface of the base portion body and having a sliding surface which is in contact with an inner wall surface of the bottom wall portion slidably in the moving direction of the cam slide, one surface of the sliding side plate extending parallel to the sliding surface of the sliding bottom plate serving as the sliding supported surface. However, the present invention is not limited to the same, and the cam slide base portion may, for example, include a base portion body with which the tool mounting portion is integrally formed and a pair of projecting portions formed integrally on the base portion body and projecting in the direction perpendicular to the moving direction of the cam slide, wherein each of the side wall portions includes a side wall portion body and a sliding side plate which is fitted to an inner wall surface of the side wall portion body and has a sliding surface being brought into contact with a projecting top surface of a corresponding one of the projecting portions slidably in the moving direction of the earn slide, and wherein the bottom wall portion includes a bottom wall portion body and a sliding bottom plate which is fitted to an inner wall surface of the bottom wall portion body and has a sliding surface being brought into contact with bottom surfaces of the base portion body and the projecting portion slidably in the moving direction of the cam slide, a surface of the projecting portion extending parallel to the sliding surface of the sliding bottom plate serving as the sliding supported surface. In other words, it suffices if the sliding side plates are disposed on either one or both of the cam slide base portion and the side wall portions, and the sliding bottom plate is also sufficient if it is disposed on either one or both of the cam slide base portion and the bottom wall portion.

The returning mechanism, in a preferred example, includes a rod which is passed through a through hole extending in the moving direction of the cam slide and formed in the cam slide base portion; a rod supporting member which supports the rod slidably in the moving direction of the cam slide and is fitted to the cam slide base portion; and a coil spring disposed between the front wall portion and the rod supporting member in such a manner as to surround the rod, so as to resiliently urge the cam slide toward the rear wall portion of the cam-slide supporting base.

The cam apparatus, in a preferred example, is a suspended cam type in which the cam slide is adapted to be suspended by the cam-slide supporting means. In this case, the rear wall portion may have a pair of half rear wall portions opposing each other with a gap therebetween; the rod may have one enlarged end portion abutting against the front wall portion of the cam-slide supporting base and another enlarged end portion located in the gap between the pair of half rear wall portions of the rear wall portion of the cam-slide supporting base; and the cam-slide supporting means may have a front-portion drop preventing plate which opposes the one enlarged end portion and is detachably fitted to the front wall portion by means of a bolt and a rear-portion drop preventing plate which opposes the another enlarged end portion and is detachably fitted to the rear wall portion by means of a bolt in such a manner as to bridge the pair of half rear wall portions.

In the cam apparatus of the suspended cam type, since the front-portion drop preventing plate and the rear-portion drop preventing plate are provided, even if the cam-slide supporting plates on the backward side are disengaged from the cam-slide supporting base, it is possible to prevent an unintentional drop of the cam slide from the cam-slide supporting base, so that the apparatus is extremely fail-safe. Moreover, since the front-portion drop preventing plate and the rear-portion drop preventing plate are fitted by means of bolts, by loosening and removing the bolts, the front-portion drop preventing plate and the rear-portion drop preventing plate can be removed simply.

The rod is sufficient if it has a rod main body and a rod subsidiary body secured threadedly at one end portion thereof to one end portion of the rod main body. If the rod is thus constructed, since the rod main body and the rod subsidiary body can be easily separated from each other, the coil spring can be easily removed and fitted with respect to the rod.

The coil spring may have one end portion abutting against the one enlarged end portion and the other end portion abutting against the rod supporting member or an adjusting plate disposed between the coil spring and the rod supporting member. In such a case, it is possible to optimally adjust the resiliency of the coil spring and, hence, the returning force by using the adjusting plate of an appropriate thickness.

Advantages of the Invention

In accordance with the invention, it is possible to provide a cam apparatus which makes it possible to easily effect the dismounting and mounting of the cam slide with respect to the cam-slide supporting base without performing troublesome operation, thereby making it possible to speedily carry out the operation of maintenance, inspection, and replacement of the cam slide, the returning mechanism, and the like.

Hereafter, a more detailed description will be given of the present invention and its embodiment with reference to the illustrated embodiment. It should be noted that the present invention is not limited to this embodiment.

BEST MODE FOR CARRYING OUT THE INVENTION

Figure 1:
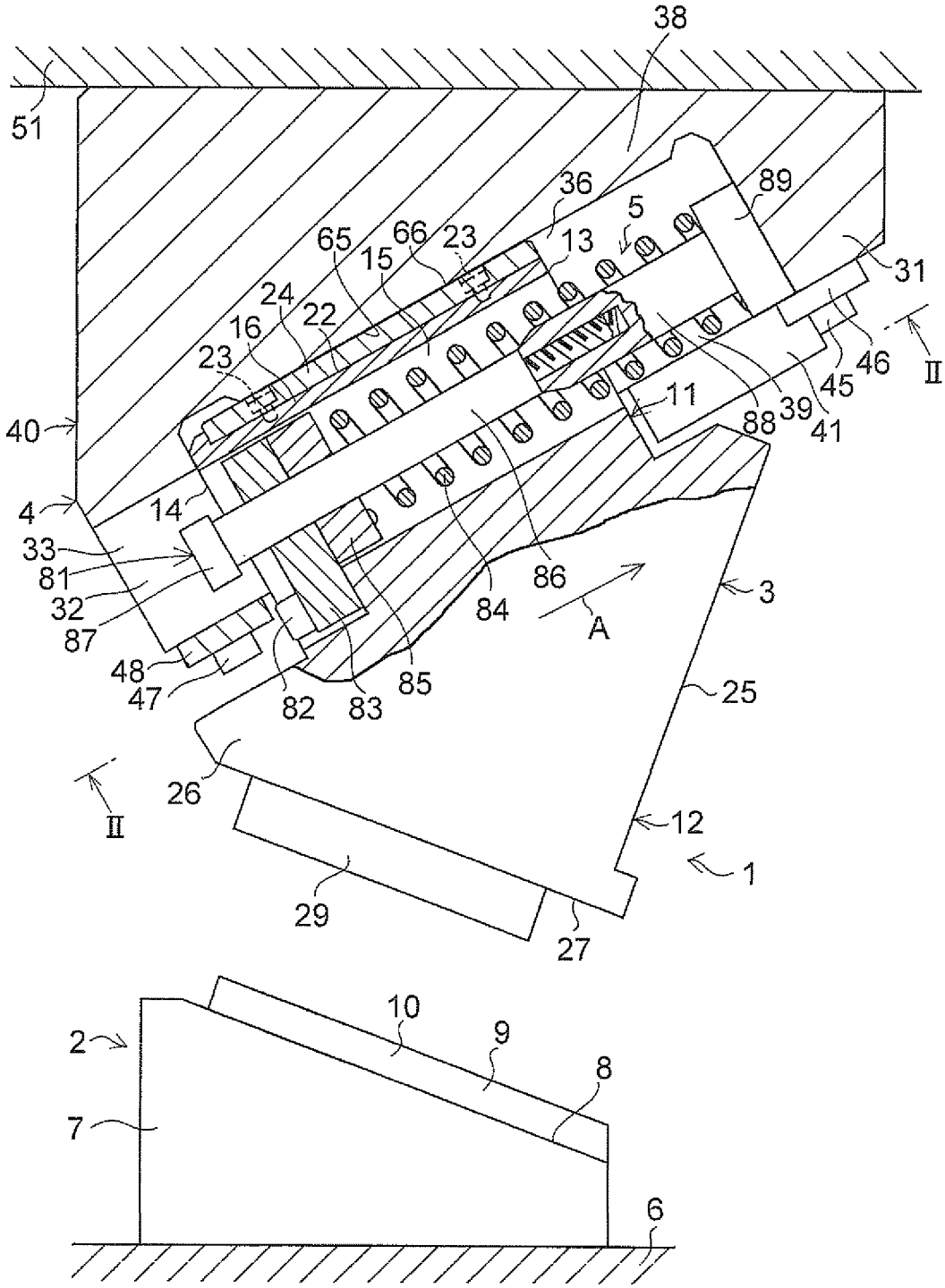
FIG. 1 is an explanatory cross-sectional of a preferred embodiment of the present invention.
Figure 2:
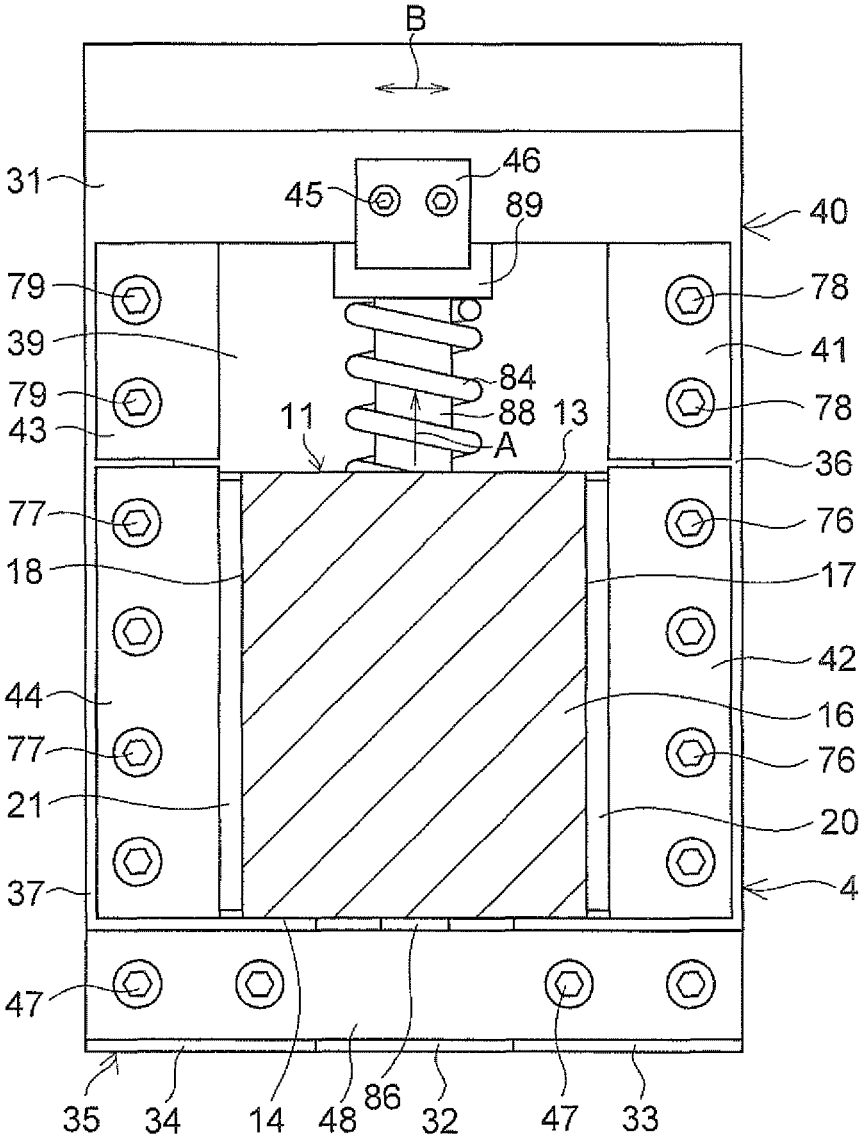
FIG. 2 is a cross-sectional view, taken in the direction of arrows along line II-II, of the embodiment shown in FIG. 1.
Figure 3:
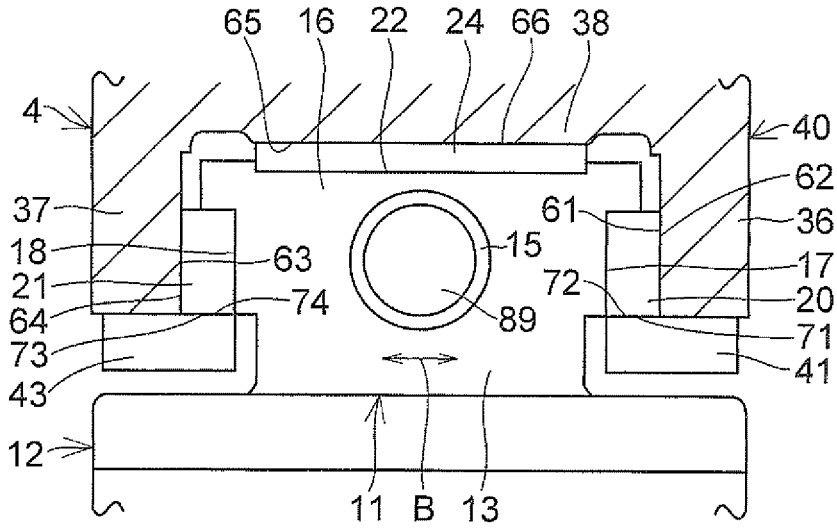
FIG. 3 is an explanatory front view of the embodiment shown in FIG. 1.
Figure 4:
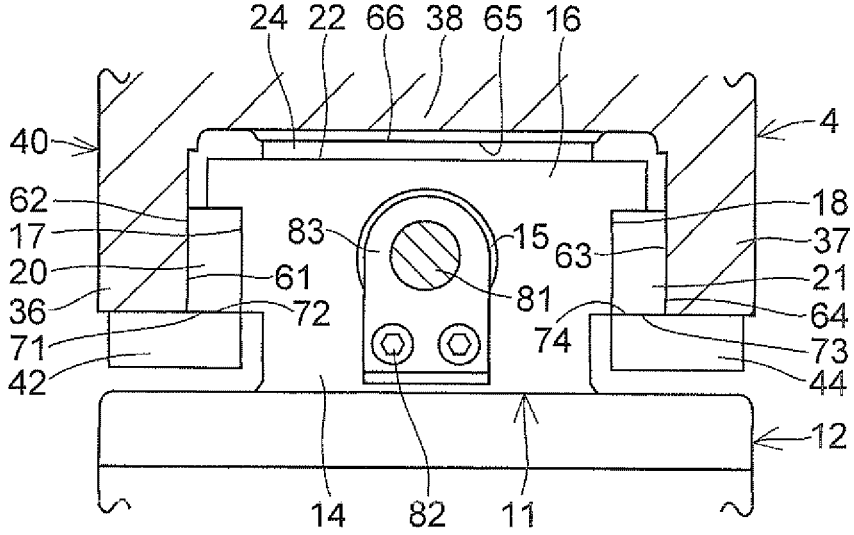
FIG. 4 is an explanatory rear view of the embodiment shown in FIG. 1.
Figure 5:
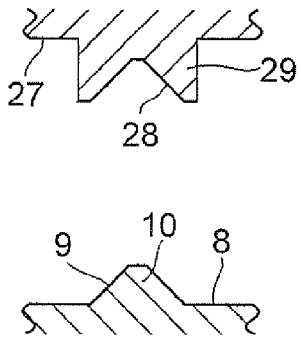
FIG. 5 is an explanatory cross-sectional view of a sliding surface of the embodiment shown in FIG. 1.

In FIGS. 1 to 5, a cam apparatus 1 of the suspended cam type in accordance with this embodiment is comprised of a cam driver 2; a cam slide 3 which is moved in contact with the cam driver 2; a cam-slide supporting means 4 for supporting the cam slide 3 movably in an A direction; and a returning mechanism 5 for returning the cam slide 3 to its rear initial position (position shown in FIG. 1) in the A direction of that cam slide 3.

The cam driver 2 includes a base body 7 fixed to a cam-driver supporting base 6 by means of bolts or the like and a projecting portion 10 formed integrally on an inclined upper surface 8 of the base body 7 and having a V-shaped sliding surface 9.

The cam slide 3 has a rectangular parallelepiped cam slide base portion 11 and a tool mounting portion 12 extending from the cam slide base portion 11.

The cam slide base portion 11 includes a base portion body 16 with which the tool mounting portion 12 is integrally formed and which has a through hole 15 extending from a front surface 13 to a rear surface 14; sliding side plates 20 and 21 which are respectively fitted to both side surfaces 17 and 18 of the base portion body 16 by means of stud bolts 19 (see FIG. 7); and a sliding bottom plate 24 fitted to a bottom surface 22 of the base portion body 16 by means of stud bolts 23.

The tool mounting portion 12 includes a mounting portion body 26 formed integrally on the base portion body 16 and having a front surface 25 to which a tool such as an edge tool or the like is mounted by means of bolts or the like; and a bifurcated projecting portion 29 formed integrally on an inclined lower surface 27 of the mounting portion body 26 and having an inverse V-shaped sliding surface 28 with a shape complementary to the sliding surface 9.

As the cam slide 3 is lowered, the bifurcated projecting portion 29 at its sliding surface 28 comes into contact with the sliding surface 9 of the projecting portion 10 and slides in the A direction, and the cam slide 3 is thereby adapted to be moved in the A direction while being guided by the sliding surface 9 of the projecting portion 10 of the cam driver 2.

The cam-slide supporting means 4 includes a cam-slide supporting base 40 which integrally has a front wall portion 31 disposed on a forward side in the A direction, a rear wall portion 35 disposed on a backward side in the A direction in face-to-face relation to the front wall portion 31 and having a pair of half rear wall portions 33 and 34 opposing each other with a gap 32 therebetween, a pair of side wall portions 36 and 37 extending in the A direction and connected on its forward side to the front wall portion 31 and on its backward side to the rear wall portion 35, and a bottom wall portion 38 which is connected to the front wall portion 31, the rear wall portion 35, and the pair of side wall portions 36 and 37, respectively, so as to form an accommodating recess 39 for accommodating the cam slide base portion 11 movably in the A direction by the front wall portion 31, the rear wall portion 35, the pair of side wall portions 36 and 37, and the bottom wall portion 38; two pairs of cam-slide supporting plates 41 and 42 as well as 43 and 44, which are respectively fitted to the pair of side wall portions 36 and 37 of the cam-slide supporting base 40 in such a manner as to be respectively aligned in the direction A; a front-portion drop preventing plate 46 which is detachably fitted to the underside of the front wall portion 31 by means of bolts 45; and a rear-portion drop preventing plate 48 which is detachably fitted to the underside of the rear wall portion 35 by means of bolts 47 in such a manner as to bridge the pair of half rear wall portions 33 and 34.

The cam-slide supporting base 40 is secured to a foundation bed 51, which is mounted to a hydraulic ram or the like, by means of bolts or the like, and is lowered toward the cam driver 2 by the operation of the hydraulic ram. In consequence, the cam slide 3 is also lowered toward the cam driver 2 through the cam-slide supporting means 4 and is adapted to be moved in the A direction as the sliding surface 28 of the bifurcated projecting portion 29, after contacting the sliding surface 9 of the projecting portion 10, is slid on the sliding surface 9 in the A direction while being guided by that sliding surface 9.

The sliding side plate 20 has a sliding surface 62 which is contact with an inner wall surface 61 of the corresponding side wall portion 36 slidably in the A direction. The sliding side plate 21 has a sliding surface 64 which is contact with an inner wall surface 63 of the corresponding side wall portion 37 slidably in the A direction. The sliding bottom plate 24 has a sliding surface 66 which is contact with an inner wall surface 65 of the bottom wall portion 38 slidably in the A direction.

Each of the pair of cam-slide supporting plates 41 and 42 has a supporting surface 72 which opposes a surface 71 of the sliding side plate 20 serving as a sliding supported surface jutting out in a B direction perpendicular to the A direction from each side surface in the B direction of the cam slide 3, and which comes into contact with that surface 71 slidably in the A direction so as to suspend and support the rectangular parallelepiped cam slide base portion 11 and, hence, the cam slide 3. Each of the pair of cam-slide supporting plates 43 and 44 also has a supporting surface 74 which opposes a surface 73 of the sliding side plate 21 serving as a sliding supported surface jutting out in the B direction perpendicular to the A direction from each side surface in that perpendicular direction of the cam slide 3, and which comes into contact with that surface 73 slidably in the A direction so as to suspend and support the rectangular parallelepiped cam slide base portion 11 and, hence, the cam slide 3 in cooperation with each of the pair of cam-slide supporting plates 41 and 42.

Thus, the rectangular parallelepiped cam slide base portion 11 has the surfaces 71 and 73 serving as the sliding supported surfaces which jut out in the B direction from the respective side surfaces in the B direction, and extend parallel to the sliding surface 66 of the sliding bottom plate 24. Further, the pairs of cam-slide supporting plates 41 and 42 as well as 43 and 44 respectively have the supporting surfaces 72 and 74 each opposing the corresponding one of the surfaces 71 and 73 serving as the sliding supported surfaces of the cam slide base portion 11.

In the pair of cam-slide supporting plates 41 and 42 and the pair of cam-slide supporting plates 43 and 44, each of the cam-slide supporting plates 41 and 43 located on the forward side in the A direction has an A-direction length which is shorter than the length in which the A-direction length of the cam slide base portion 11 accommodated in the accommodating recess 39 is subtracted from the A-direction length of the accommodating recess 39. Meanwhile, in the pair of cam-slide supporting plates 41 and 42 and the pair of cam-slide supporting plates 43 and 44, each of the cam-slide supporting plates 42 and 44 located on the backward side in the A direction is detachably fitted to a corresponding one of the side wall portions 36 and 37 by means of stud bolts 76 and 77. In this embodiment, each of the cam-slide supporting plates 41 and 43 on the forward side is also detachably fitted to a corresponding one of the side wall portions 36 and 37 by means of bolts 78 and 79.

The returning mechanism 5 includes a rod 81 which is passed through the through hole 15 and has on the whole a smaller diameter than the diameter of the through hole 15; a rod supporting member 83 which supports the rod 81 slidably in the A direction, and which is detachably fitted to the base portion body 16 of the cam slide 3 at an open end on the backward side of the through hole 15 in the A direction by means of bolts 82; a coil spring 84 disposed in such a manner as to surround the rod 81 and having a smaller diameter than the diameter of the through hole 15, so as to return the cam slide 3 to its initial position (position shown in FIG. 1) by resiliently urging the cam slide 3 toward the rear wall portion 35 located on the backward side in the A direction; and an annular adjusting plate 85 disposed between the coil spring 84 and the rod supporting member 83 and having a smaller diameter than the diameter of the through hole 15, so as to adjust the spring force of the coil spring 84 by its thickness.

The rod 81 has a rod main body 86; an enlarged end portion 87 formed integrally at one end portion of the rod main body 86 and located in the gap 32; a rod subsidiary body 88 secured threadedly at its one end portion to the other end portion of the rod main body 86 and having a larger diameter than the diameter of the rod main body 86; and an enlarged end portion 89 provided integrally at the rod subsidiary body 88 and coming into contact with the front wall portion 31.

The coil spring 84 abuts against, at one end, the enlarged end portion 89 and, at the other end, the adjusting plate 85 fitted over the rod main body 86. In a case where the enlarged end portion 89 is not provided, the one end of the coil spring 84 may be brought into contact with the front wall portion 31. In addition, in a case where the adjusting plate 85 is not provided, the other end of the coil spring 84 may be brought into contact with the rod supporting member 83.

Figure 6:
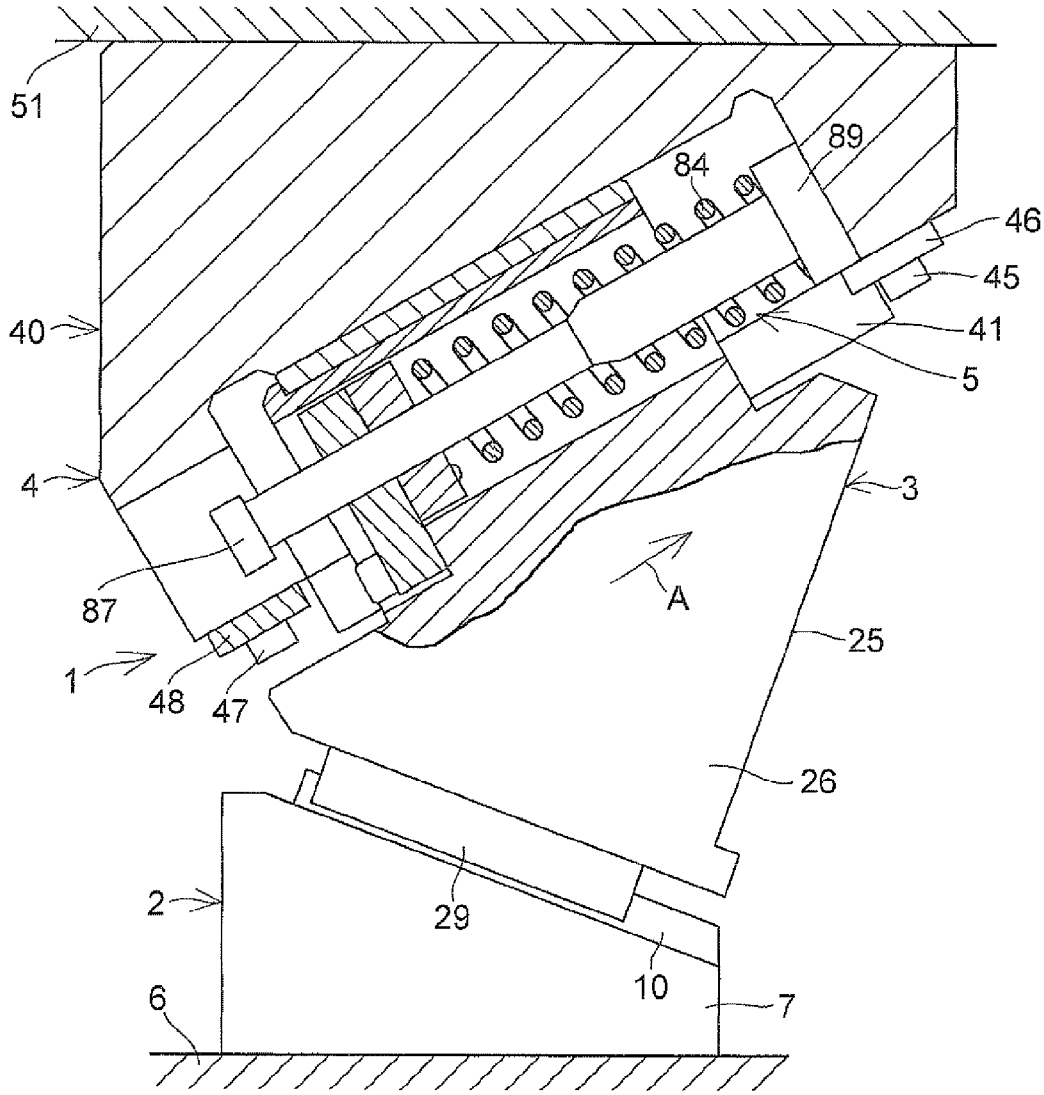
FIG. 6 is a diagram explaining the operation of the embodiment shown in FIG. 1.

As for the returning mechanism 5, as the foundation bed 51 and the cam-slide supporting base 40 are lowered due to the operation of the hydraulic ram (not shown) connected to the foundation bed 51, the cam slide 3 is moved in the A direction by the cam driver 2, as shown in FIG. 6. Subsequently, as the cam-slide supporting base 40 together with the foundation bed 51 is raised due to the reverse operation of the hydraulic ram, the returning mechanism 5 moves the cam slide 3 in an opposite direction to the A direction, i.e., backwardly in the A direction, by means of the resiliency of the coil spring 84, thereby returning the cam slide 3 to its initial position in which the end face 14 of the base portion body 16 abuts against the rear wall portion 35, as shown in FIG. 1.

The front-portion drop preventing plate 46 opposes the enlarged end portion 89, while the rear-portion drop preventing plate 48 opposes the enlarged end portion 87, so that even if the bolts 76 to 79 have loosened and the pair of cam-slide supporting plates 41 and 42 and the pair of cam-slide supporting plates 43 and 44 have dropped from the side wall portions 36 and 37, the front-portion drop preventing plate 46 and the rear-portion drop preventing plate 48 are adapted to receive the enlarged end portions 89 and 87 from below, to thereby prevent the cam slide 3 from dropping off the cam-slide supporting base 40. The arrangement provided is such that the front-portion drop preventing plate 46 and the rear-portion drop preventing plate 48 can be respectively removed from the front wall portion 31 and the rear wall portion 35 by loosening and removing the bolts 45 and 47.

In the above-described cam apparatus 1 of the suspended cam type in which the cam slide 3 is suspended by the cam-slide supporting means 4, when the hydraulic ram is operated in the state in which the cam slide 3 has been returned to the initial position shown in FIG. 1, and the cam-slide supporting base 40 together with the foundation bed 51 is lowered, the cam slide 3 is moved in the A direction due to the contact of its sliding surface 28 against the sliding surface 9 of the cam driver 2, as shown in FIG. 6. Then, bending work, for example, is provided by a tool attached to the front surface 25 of the mounting portion body 26.

After the bending work, in the cam apparatus 1, if the hydraulic ram is reversely operated, and the cam-slide supporting base 40 together with the foundation bed 51 is raised, the cam slide 3, in conjunction with the cancellation of the contact of its sliding surface 28 against the sliding surface 9 of the cam driver 2, is moved backwardly in the A direction by the resiliency of the coil spring 84 of the returning mechanism 5, thereby returning to its initial position, as shown in FIG. 1.

Figure 7:
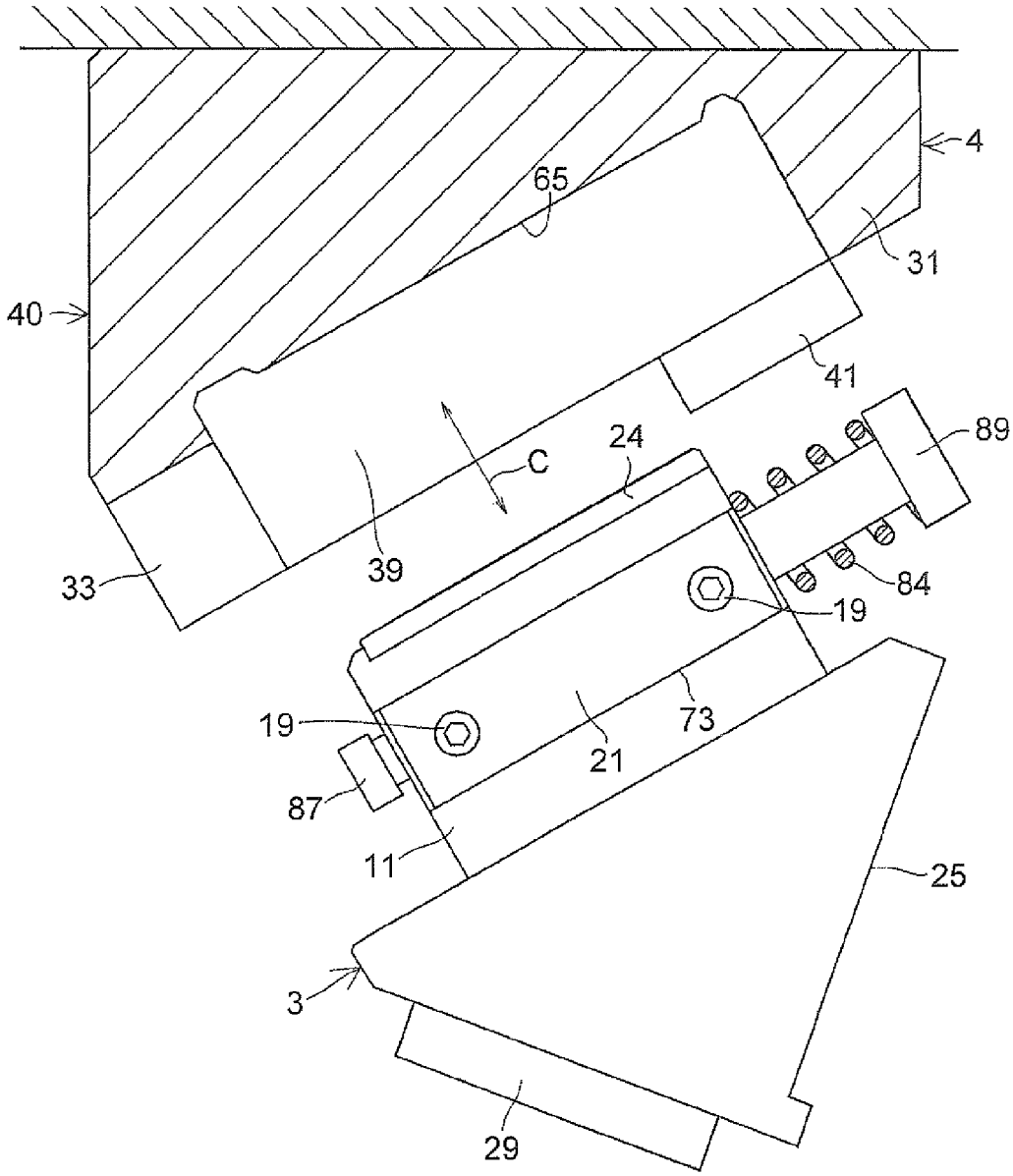
FIG. 7 is a diagram explaining the operation of the embodiment shown in FIG. 1.

Incidentally, with the cam apparatus 1, in the cam-slide supporting plates 41 and 42 as well as 43 and 44, each of the cam-slide supporting plates 41 and 43 located on the forward side in the A direction has an A-direction length which is shorter than the length in which the A-direction length of each of the surfaces 71 and 73 serving as the supported surfaces of the cam slide base portion 11 is subtracted from the A-direction length of the accommodating recess 39. Meanwhile, in the cam-slide supporting plates 41 and 42 as well as 43 and 44, each of the cam-slide supporting plates 42 and 44 located on the backward side in the A direction is detachably fitted to a corresponding one of the side wall portions 36 and 37 by means of the bolts 76 and 77. Therefore, even in a case where the bolts 78 and 79 cannot be loosened due to the fact that the cam slide 3 per se and/or an adjacent cam slide or the like serves as an obstruction, and the cam-slide supporting plates 41 and 43 located on the forward side in the A direction cannot be removed from the side wall portions 36 and 37, the cam-slide supporting plates 42 and 44 located on the backward side in the A direction can be removed from the side wall portions 36 and 37, thereby making it possible to withdraw or insert the cam slide base portion 11 with respect to the accommodating recess 39 through the opening of the accommodating recess 39 in a C direction perpendicular to the A direction, as shown in FIG. 7. As a result, it is possible to easily effect the dismounting and mounting of the cam slide 3 with respect to the cam-slide supporting base 11 without performing troublesome operation, thereby making it possible to speedily perform the operation of maintenance, inspection, and replacement of the cam slide 3, the returning mechanism 5, and the like.

In the case where the front-portion drop preventing plate 46 and the rear-portion drop preventing plate 48 are provided as in this embodiment, at the time of insertion or withdrawal of the cam slide base portion 11 with respect to the accommodating recess 39, the front-portion drop preventing plate 46 and the rear-portion drop preventing plate 48 may also be removed respectively from the front wall portion 31 and the rear wall portion 35 by loosening the bolts 45 and 47. However, in a case where the front-portion drop preventing plate 46 and the rear-portion drop preventing plate 48 cannot be removed, particularly in a case where the front-portion drop preventing plate 46 cannot be removed due to the fact that the cam slide 3 per se and/or an adjacent cam slide or the like serves as an obstruction, the rod supporting member 83 may be removed from the base portion body 16 by loosening the bolts 82. Then, the entire returning mechanism 5 may be moved in the opposite direction to the A direction so as to be drawn out from the accommodating recess 39 and the through hole 15, thereby allowing the entire returning mechanism 5 to be dismounted from the cam slide base portion 11.

In addition, with the cam apparatus 1, since the rod 81 has the rod main body 86 and the rod subsidiary body 88 secured threadedly to the rod main body 86, the rod main body 86 and the rod subsidiary body 88 can be easily separated from each other, so that the coil spring 84 can be easily removed and fitted with respect to the rod 81. Furthermore, since the rod 81 has the enlarged end portions 87 and 89, it is possible to reliably prevent the rod 81 from unintentionally coming off the rod supporting member 83.

The invention claimed is:

1. A cam apparatus comprising:

a cam driver;

a cam slide which is moved in contact with said cam driver;

cam-slide supporting means for supporting said cam slide movably; and a returning mechanism for returning said cam slide to a rear initial position thereof in a moving direction of said cam slide, wherein said cam slide includes: a rectangular parallelepiped cam slide base portion having a pair of sliding supported surfaces each extending in a direction perpendicular to the moving direction of said cam slide; and a tool mounting portion extending from said cam slide base portion, wherein said cam-slide supporting means includes: a cam-slide supporting base which has a front wall portion disposed on a forward side in the moving direction of said cam slide, a rear wall portion disposed on a backward side in the moving direction of said cam slide in face-to-face relation to the front wall portion, a pair of side wall portions extending in the moving direction of said cam slide and connected on a forward side thereof to said front wall portion and on a backward side thereof to said rear wall portion, and a bottom wall portion which is connected to said front wall portion, said rear wall portion, and said pair of side wall portions, respectively, so as to form an accommodating recess for accommodating said cam slide base portion movably in the moving direction; and two pairs of cam-slide supporting plates which are respectively fitted to said pair of side wall portions of said cam-slide supporting base in such a manner as to be respectively aligned in the moving direction of said cam slide, and each of which has a supporting surface opposing a corresponding one of the sliding supported surfaces of said cam slide base portion, wherein, in each of said pairs of cam-slide supporting plates, said cam-slide supporting plate located on the forward side in the moving direction of said cam slide has a moving-direction length shorter than a length in which a moving-direction length of said cam slide base portion accommodated in said accommodating recess is subtracted from a length of said accommodating recess in the moving direction of said cam slide, and wherein, in each of said pairs of cam-slide supporting plates, said cam-slide supporting plate located on the backward side in the moving direction of said cam slide is detachably fitted to said side wall portion by means of a bolt.

2. The cam apparatus according to claim 1, wherein said cam slide base portion includes a base portion body with which said tool mounting portion is integrally formed; a pair of sliding side plates which are respectively fitted to both side surfaces of said base portion body and each has a sliding surface which is in contact with an inner wall surface of a corresponding one of said side wall portions slidably in the moving direction of said cam slide; and a sliding bottom plate fitted to a bottom surface of said base portion body and having a sliding surface which is in contact with an inner wall surface of said bottom wall portion slidably in the moving direction of said cam slide, one surface of each of said sliding side plates extending parallel to the sliding surface of said sliding bottom plate serving as the sliding supported surface.

3. The cam apparatus according to claim 1, wherein said returning mechanism includes a rod which is passed through a through hole extending in the moving direction of said cam slide and formed in said cam slide base portion; a rod supporting member which supports said rod slidably in the moving direction of said cam slide and is fitted to said cam slide base portion; and a coil spring disposed between said front wall portion and said rod supporting member and surrounding said rod, so as to resiliently urge said cam slide toward said rear wall portion of said cam-slide supporting base.

4. The cam apparatus according to claim 1, wherein said cam apparatus is a suspended cam, said rear wall portion having a pair of half rear wall portions opposing each other with a gap therebetween, a rod having one enlarged end portion abutting against said front wall portion of said cam-slide supporting base and another enlarged end portion located in the gap between the pair of half rear wall portions of said rear wall portion of said cam-slide supporting base, said cam-slide supporting means having a front-portion drop preventing plate which opposes said one enlarged end portion and is detachably fitted to said front wall portion by means of a bolt and a rear-portion drop preventing plate which opposes said another enlarged end portion and is detachably fitted to said rear wall portion by means of a bolt so as to bridge said pair of half rear wall portions, said cam slide being adapted to be suspended by said cam-slide supporting means.

* * * * *